US008118950B2

(12) United States Patent
Colvin et al.

(10) Patent No.: US 8,118,950 B2
(45) Date of Patent: Feb. 21, 2012

(54) ALUMINUM-COPPER-LITHIUM ALLOYS

(75) Inventors: Edward L. Colvin, West Lafayette, IN (US); Roberto J. Rioja, Murrysville, PA (US); Les A. Yocum, West Lafayette, IN (US); Diana K. Denzer, Lower Burrell, PA (US); Todd K. Cogswell, Lafayette, IN (US); Gary H. Bray, Murrysville, PA (US); Ralph R. Sawtell, Gibsonia, PA (US); Andre L. Wilson, Bettendorf, IA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 12/328,622

(22) Filed: Dec. 4, 2008

(65) Prior Publication Data

US 2009/0142222 A1 Jun. 4, 2009

Related U.S. Application Data

(60) Provisional application No. 60/992,330, filed on Dec. 4, 2007.

(51) Int. Cl.
*C22C 21/12* (2006.01)

(52) U.S. Cl. ..... 148/417; 420/532; 420/533; 420/539

(58) Field of Classification Search ..... 148/417; 420/533, 532, 539
See application file for complete search history.

(56) References Cited

U.S. PATENT DOCUMENTS

| | | | | |
|---|---|---|---|---|
| 1,620,082 | A | 3/1927 | Czochralski | 420/531 |
| 2,381,219 | A | 8/1945 | Le Baron | 420/529 |
| 2,915,391 | A | 12/1959 | Criner | 148/439 |
| 3,288,601 | A | 11/1966 | Flemings et al. | 420/535 |
| 3,475,166 | A | 10/1969 | Raffin | 420/532 |
| 3,563,730 | A | 2/1971 | Bach et al. | 420/402 |
| 3,876,474 | A | 4/1975 | Watts et al. | 420/533 |
| 3,925,067 | A | 12/1975 | Sperry et al. | 420/535 |
| 4,094,705 | A | 6/1978 | Sperry et al. | 420/533 |
| 4,526,630 | A | 7/1985 | Field | 148/700 |
| 4,584,173 | A | 4/1986 | Gray et al. | 420/533 |
| 4,588,553 | A | 5/1986 | Evans et al. | 420/533 |
| 4,594,222 | A | 6/1986 | Heck et al. | 420/529 |
| 4,597,792 | A | 7/1986 | Webster | 75/249 |
| 4,603,029 | A | 7/1986 | Quist et al. | 420/535 |

(Continued)

FOREIGN PATENT DOCUMENTS

EP 0227563 7/1987

(Continued)

OTHER PUBLICATIONS

Article 19 Amendment filed in corresponding International Application No. PCT/US2008/085547 on Apr. 24, 2009.

(Continued)

*Primary Examiner* — Scott Kastler
*Assistant Examiner* — Janelle Morillo
(74) *Attorney, Agent, or Firm* — Greenberg Traurig, LLP

(57) ABSTRACT

Improved aluminum-copper-lithium alloys are disclosed. The alloys may include 3.4-4.2 wt. % Cu, 0.9-1.4 wt. % Li, 0.3-0.7 wt. % Ag, 0.1-0.6 wt. % Mg, 0.2-0.8 wt. % Zn, 0.1-0.6 wt. % Mn, and 0.01-0.6 wt. % of at least one grain structure control element, the balance being aluminum and incidental elements and impurities. The alloys achieve an improved combination of properties over prior art alloys.

16 Claims, 6 Drawing Sheets

U.S. PATENT DOCUMENTS

| | | | | |
|---|---|---|---|---|
| 4,624,717 | A | 11/1986 | Miller | 148/693 |
| 4,626,409 | A | 12/1986 | Miller | 420/533 |
| 4,635,842 | A | 1/1987 | Mohondro | 228/175 |
| 4,648,913 | A | 3/1987 | Hunt, Jr. et al. | 148/693 |
| 4,661,172 | A | 4/1987 | Skinner et al. | 419/28 |
| 4,717,068 | A | 1/1988 | Meyer | 228/203 |
| 4,735,774 | A | 4/1988 | Narayanan et al. | 420/533 |
| 4,752,343 | A | 6/1988 | Dubost et al. | 148/502 |
| 4,758,286 | A | 7/1988 | Dubost et al. | 148/695 |
| 4,772,342 | A | 9/1988 | Polmear | 148/418 |
| 4,795,502 | A | 1/1989 | Cho | 148/693 |
| 4,797,165 | A | 1/1989 | Bretz et al. | 148/695 |
| 4,801,339 | A | 1/1989 | Osborn et al. | 419/29 |
| 4,806,174 | A | 2/1989 | Cho et al. | 148/693 |
| 4,812,178 | A | 3/1989 | Dubost | 148/695 |
| 4,816,087 | A | 3/1989 | Cho | 148/692 |
| 4,832,910 | A | 5/1989 | Rioja et al. | 420/528 |
| 4,840,682 | A | 6/1989 | Curtis et al. | 148/695 |
| 4,840,683 | A | 6/1989 | Dubost | 148/549 |
| 4,842,822 | A | 6/1989 | Colvin et al. | 420/533 |
| 4,844,750 | A | 7/1989 | Cho et al. | 148/693 |
| 4,848,647 | A | 7/1989 | Gentry et al. | 228/262 |
| 4,851,192 | A | 7/1989 | Baba et al. | 420/528 |
| 4,863,528 | A | 9/1989 | Brown et al. | 148/695 |
| 4,869,870 | A | 9/1989 | Rioja et al. | 420/532 |
| 4,894,096 | A | 1/1990 | Meyer | 148/502 |
| 4,897,126 | A | 1/1990 | Bretz et al. | 148/697 |
| 4,915,747 | A | 4/1990 | Cho | 148/693 |
| 4,921,548 | A | 5/1990 | Cho | 148/693 |
| 4,955,413 | A | 9/1990 | Meyer et al. | 148/502 |
| 4,961,792 | A | 10/1990 | Rioja et al. | 148/552 |
| 5,032,359 | A | 7/1991 | Pickens et al. | 420/533 |
| 5,066,342 | A | 11/1991 | Rioja et al. | 148/693 |
| 5,076,859 | A | 12/1991 | Rioja et al. | 148/698 |
| 5,108,519 | A | 4/1992 | Armanie et al. | 148/689 |
| 5,116,572 | A | 5/1992 | Narayanan et al. | 420/533 |
| 5,122,339 | A | 6/1992 | Pickens et al. | 420/533 |
| 5,135,713 | A | 8/1992 | Rioja et al. | 420/532 |
| 5,137,686 | A | 8/1992 | Rioja et al. | 420/528 |
| 5,151,136 | A | 9/1992 | Witters et al. | 148/689 |
| 5,198,045 | A | 3/1993 | Cho et al. | 148/552 |
| 5,211,910 | A | 5/1993 | Pickens et al. | 420/532 |
| 5,234,662 | A | 8/1993 | Balmuth et al. | 420/529 |
| 5,259,897 | A | 11/1993 | Pickens et al. | 148/417 |
| 5,389,165 | A | 2/1995 | Cho | 148/552 |
| 5,393,357 | A | 2/1995 | Cho | 148/437 |
| 5,439,536 | A | 8/1995 | Cho | 148/697 |
| 5,455,003 | A | 10/1995 | Pickens et al. | 420/529 |
| 5,462,712 | A * | 10/1995 | Langan et al. | 420/528 |
| 5,512,241 | A | 4/1996 | Kramer et al. | 420/528 |
| 6,551,424 | B1 | 4/2003 | Haszler et al. | 148/552 |
| 7,229,508 | B2 | 6/2007 | Cho | 148/417 |
| 7,229,509 | B2 * | 6/2007 | Cho | 148/417 |
| 2002/0015658 | A1 | 2/2002 | Rioja et al. | 420/540 |
| 2002/0134474 | A1 | 9/2002 | Cho | 148/699 |
| 2003/0226935 | A1 | 12/2003 | Garratt et al. | 428/598 |
| 2004/0071586 | A1 | 4/2004 | Rioja et al. | 420/529 |
| 2005/0189048 | A1 | 9/2005 | Cho | 148/699 |
| 2007/0181229 | A1 | 8/2007 | Bes et al. | 148/438 |
| 2007/0258847 | A1 | 11/2007 | Cho | 420/533 |
| 2008/0289728 | A1 | 11/2008 | Bes | 148/552 |
| 2008/0292491 | A1 | 11/2008 | Fridlyander et al. | 420/533 |

FOREIGN PATENT DOCUMENTS

| | | |
|---|---|---|
| EP | 0273600 | 7/1988 |
| EP | 1788101 | 5/2007 |
| GB | 0353891 | 7/1931 |
| GB | 0522050 | 6/1940 |
| GB | 1090960 | 11/1967 |
| JP | 60-238439 | 11/1985 |
| JP | 61-023751 | 1/1986 |
| JP | 61-133358 | 6/1986 |
| JP | 61-231145 | 10/1986 |
| JP | 64-025954 | 1/1989 |
| JP | 03107440 | 5/1991 |
| RU | 2237098 | 9/2004 |
| WO | WO 2009/036953 | 3/2009 |

OTHER PUBLICATIONS

Balmuth et al., *Fracture and Fatigue Crack Growth Resistance of Recrystallized Al-Li Alloys*, Materials Science Forum, vol. 217-222, p. 1365-1370 (1996).

Baumann et al., *The effect of Ternary Additions on the δ'/α Misfit and the δ' Solvus Line in Al-Li Alloys*, Department of Metallurgy and Materials Engineering, Lehigh University, in Aluminum-Lithium Alloys II at Monterey, California, p. 17-29 (Apr. 12-14, 1983).

Baumann, S., *Aspects of δ' ($Al_3Li$) Precipitation in Dilute Al-Li Binary and Al-Li-X Ternary Alloys*, A Dissertation Presented to the Graduate Committee of Lehigh University in Candidacy for the Degree of Doctor of Philosophy in the Department of Metallurgy and Materials Engineering, p. 1-198 (1983).

Bretz, P., *Aluminum-Lithium Alloys*, Proceedings of the 1987 Aluminum-Lithium Symposium, p. 1-40 (Mar. 25-26, 1987).

Cegedur Trans Alum, High Strength High Ductility Aluminium Based Alloy Comprising Lithium, Copper, and Magnesium as Additives, FR2561261-A, p. 1 (Mar. 15, 1984).

Chester et al., *Precipitation in Al-Cu-Mg-Ag Alloys*, The Metallurgy of Light Alloys, p. 75-81 (1983).

Chester et al., *TEM Investigation of Precipitates in Al-Cu-Mg-Ag and Al-Cu-Mg Alloys*, Micron, vol. 11, p. 311-312 (1980).

Elagin et al., *Effect of Lithium on the Properties of Al-Zn-Mg Alloys*, All-Union Institute of Light Alloys, p. 1038-1041 (Dec. 1977).

Feng et al., *The effect of Minor Alloying Elements on the Mechanical Properties of Al-Cu-Li Alloys*, in Aluminum-Lithium Alloys II at Monterey, California, p. 235-253 (Apr. 12-14, 1983).

Gayle, F.W., *Alloying Additions and Property Modification in Aluminum-Lithium-X Systems*, Reynolds Metal Company, Metallurgical Research Division, in Aluminum-Lithium Alloys at Stone Mountain, Georgia, p. 120-139 (May 19-21, 1980).

Hatch, J., *Effects of Alloying Elements and Impurities on Properties*, Aluminum Properties and Physical Metallurgy, ISBN 0-87170-176-6, p. 201-203 (May 1984).

Hayashi et al., *Aging Phenomena of Al-Li-Mg Alloy Affected by Additional Elements*, Journal of Japan Institute of Light Metals, vol. 32, No. 7, p. 350-355 (Jul. 1982). (English Translation p. 1-11).

Hunsicker et al., *Stress-Corrosion Resistance of High-Strength Al-Zn-Mg-Cu Alloys with and without Silver Additions*, Metallurgical Transactions, vol. 3, p. 201-209 (Jan. 1972).

Jones et al., *The Mechanical Properties of Aluminium-Lithium Alloys*, Journal of the Institute of Metals, vol. 88, p. 435-443 (1960).

Kennedy, A. J., *The Prospects for Materials*, The Aeronautical Journal of the Royal Aeronautical Society, vol. 73, No. 697, p. 1-8 (Jan. 1969).

Kojima et al., *Effect of Lithium Addition on the Elevated Temperature Properties of 2219 Alloy*, Journal of Japan Institute of Light Metals, vol. 36, No. 11, p. 737-743 (1986). (English Translation p. 1-16).

Lavernia et al., *Review Aluminium-Lithium Alloys*, Journal of Materials Science, vol. 22, p. 1521-1529 (1987).

Marchive et al., *Processing and Properties of 2091 and 8090 Forgings*, Journal De Physique, Colloque C3, Tome 48, p. 43-48 (Sep. 1987).

Meister et al., *Welding of Aluminum and Aluminum Alloys*, Defense Metals Information Center, DMIC Report 236, p. 47-49 (Apr. 1, 1967).

Mondolfo, L. F., *Aluminum Alloys: Structure and Properties*, Aluminum-Copper Alloys, ISBN 0408709324, p. 502, 641, 693-725 (1976).

Noble et al., *The Elastic Modulus of Aluminium-Lithium Alloys*, Journal of Materials Science, vol. 17, p. 461-468 (1982).

Polmear et al., *Design and Development of an Experimental Wrought Aluminum Alloy for Use at Elevated Temperatures*, Metallurgical Transactions A, vol. 19A, p. 1027-1035 (Apr. 1988).

Polmear, I.J., *Development of an Experimental Wrought Aluminium Alloy for use at Elevated Temperatures*, Aluminum Alloys-Physical and Mechanical Properties, vol. 1, p. 661-674 (Jun. 1986).

Polmear, I.J., *The Effects of Small Additions of Silver on the Aging of Some Aluminum Alloys*, Transactions of the Metallurgical Society of AIME, vol. 230 p. 1331-1339 (Oct. 1964).

Reynolds et al., *The Effect of Thermal Exposure on the Fracture Behavior of Aluminum Alloys Intended for Elevated Temperature*

*Service*, Elevated Temperature Effects on Fatigue and Fracture, ASTM STP 1297, p. 191-205 (1997).
Sen et al., *The Effect of an Addition of 0-5 wt.% Silver on the Ageing Characteristics of Certain Al-Cu-Mg Alloys*, The Institute of Metals, Monograph and Report Series No. 33, p. 49-53 (1969).
Speidel, M.O., *Development of High-Strength Aluminum Alloys*, 6$^{th}$ International Conference on Light Metals, Loeben/Vienna, p. 67-72 (1975).
Speidel, M.O., *Stress Corrosion Cracking of Aluminum Alloys*, Metallurgical Transactions A, vol. 6A, p. 631-651 (Apr. 1975).
Staley, J.T., *Investigation to Improve the Stress-Corrosion Resistance of Aluminum Aircraft Alloys through Alloy Additions and Specialized Heat Treatment*, Naval Air Systems Command Contract N00019-68-C-0146, Final Report, p. 1-208 (Feb. 28, 1969).
Vietz et al., *The Influence of Small Additions of Silver on the Ageing of Aluminium Alloys: Observations on Al-Cu-Mg Alloys*, Journal of the Institute of Metals, vol. 94, p. 410-419 (1966).
Wang et al., *Lithium-Containing 2024 Aluminum Alloys Made From Rapidly-Solidified Powders*, in Aluminum-Lithium Alloys II at Monterey, California, p. 447-467 (Apr. 12-14, 1983).
Department of Defense Handbook: Metallic Materials and Elements for Aerospace Vehicle Structures, No. MIL-HDBK-5J, pp. 9-1 to 9-270, Jan. 31, 2003, Retrieved from the Internet at http://www.everyspec.com on Jun. 30, 2010.
AMS 4413, Aerospace Material Specification, SAE Aerospace, pp. 1-5, Oct. 2007.

* cited by examiner

DIMENSION AND TOLERANCE TABLE RELATIVE TO FIG. 1a

| SIZE | B* | A | W | W1 | S MAX | E | F | 2H | D | G | ΘMAX |
|---|---|---|---|---|---|---|---|---|---|---|---|
| 1/2" | 0.50 | 0.60 | 1.000 | 1.250 | 0.095 | 0.275 | 0.55 | 1.20 | 0.250 | .095-.100 | 60° |
| 3/4" | 0.75 | 0.90 | 1.500 | 1.875 | 0.145 | 0.412 | 0.82 | 1.80 | 0.375 | .095-.100 | 60° |
| 1" | 1.00 | 1.10 | 2.000 | 2.500 | 0.185 | 0.550 | 1.10 | 2.40 | 0.500 | .095-.100 | 60° |
| 1-1/4" | 1.25 | 1.37 | 2.500 | 3.125 | 0.185 | 0.687 | 1.37 | 3.00 | 0.625 | .095-.100 | 60° |
| 1-1/2" | 1.50 | 1.65 | 3.000 | 3.750 | 0.295 | 0.825 | 1.65 | 3.60 | 0.750 | .233-.238 | 30° |
| 2" | 2.00 | 2.20 | 4.000 | 5.000 | 0.395 | 1 100 | 2.20 | 4.80 | 1.000 | .233-.238 | 30° |
| 2-1/2" | 2.50 | 2.75 | 5.000 | 6.250 | 0.460 | 1.375 | 2.75 | 600 | 1.250 | .233-.238 | 30° |
| 3" | 3.00 | 3.30 | 6.000 | 7.500 | 0.460 | 1.650 | 3.30 | 7.20 | 1.500 | .233-.238 | 30° |
| Other sizes | 0.5W (0.25-0.5W) | 0.55W | W | 1.25W | W/10 | 0.275W | 0.55W | 1.2W | 0.25W | | |

Notes: * Value shown is maximum, minimum thickness can be 1/2 this value

FIG. 1b

ALUMINUM-COPPER-LITHIUM ALLOYS

CROSS-REFERENCE TO RELATED APPLICATIONS

This patent application claims priority to U.S. Provisional Patent Application No. 60/992,330, filed Dec. 4, 2007, and entitled "IMPROVED ALUMINUM ALLOYS", and is related to PCT Patent Application No. PCT/US08/85547, filed Dec. 4, 2008. Each of the above-identified patent applications is incorporated herein by reference in its entirety.

BACKGROUND

Aluminum alloys are useful in a variety of applications. However, improving one property of an aluminum alloy without degrading another property often proves elusive. For example, it is difficult to increase the strength of an alloy without decreasing the toughness of an alloy. Other properties of interest for aluminum alloys include corrosion resistance, density and fatigue, to name a few.

SUMMARY OF THE DISCLOSURE

Broadly, the present disclosure relates to aluminum-copper-lithium alloys having an improved combination of properties.

In one aspect, the aluminum alloy is a wrought aluminum alloy consisting essentially of 3.4-4.2 wt. % Cu, 0.9-1.4 wt. % Li, 0.3-0.7 wt. % Ag, 0.1-0.6 wt. % Mg, 0.2-0.8 wt. % Zn, 0.1-0.6 wt. % Mn, and 0.01-0.6 wt. % of at least one grain structure control element, the balance being aluminum and incidental elements and impurities. The wrought product may be an extrusion, plate, sheet or forging product. In one embodiment, the wrought product is an extruded product. In one embodiment, the wrought product is a plate product. In one embodiment, the wrought product is a sheet product. In one embodiment, the wrought product is a forging.

In one approach, the alloy is an extruded aluminum alloy. In one embodiment, the alloy has an accumulated cold work of not greater than an equivalent of 4% stretch. In other embodiments, the alloy has an accumulated cold work of not greater than an equivalent of 3.5% or not greater than an equivalent of 3% or even not greater than an equivalent of 2.5% stretch. As used herein, accumulated cold work means cold work accumulated in the product after solution heat treatment.

In some embodiments, the aluminum alloy includes at least about 3.6 or 3.7 wt. %, or even at least about 3.8 wt. % Cu. In some embodiments, the aluminum alloy includes not greater than about 4.1 or 4.0 wt. % Cu. In some embodiments, the aluminum alloy includes copper in the range of from about 3.6 or 3.7 wt. % to about 4.0 or 4.1 wt. %. In one embodiment, the aluminum alloy includes copper in the range of from about 3.8 wt. % to about 4.0 wt. %.

In some embodiments, the aluminum alloy includes at least about 1.0 or 1.1 wt. % Li. In some embodiments, the aluminum alloy includes not greater than about 1.3 or 1.2 wt. % Li. In some embodiments, the aluminum alloy includes lithium in the range of from about 1.0 or 1.1 wt. % to about 1.2 or 1.3 wt. %.

In some embodiments, the aluminum alloy includes at least about 0.3 or 0.35 or 0.4 or 0.45 wt. % Zn. In some embodiments, the aluminum alloy includes not greater than about 0.7 or 0.65 or 0.6 or 0.55 wt. % Zn. In some embodiments, the aluminum alloy includes zinc in the range of from about 0.3 or 0.4 wt. % to about 0.6 or 0.7 wt. %.

In some embodiments, the aluminum alloy includes at least about 0.35 or 0.4 or 0.45 wt. % Ag. In some embodiments, the aluminum alloy includes not greater than about 0.65 or 0.6 or 0.55 wt. % Ag. In some embodiments, the aluminum alloy includes silver in the range of from about 0.35 or 0.4 or 0.45 wt. % to about 0.55 or 0.6 or 0.65 wt. %.

In some embodiments, the aluminum alloy includes at least about 0.2 or 0.25 wt. % Mg. In some embodiments, the aluminum alloy includes not greater than about 0.5 or 0.45 wt. % Mg. In some embodiments, the aluminum alloy includes magnesium in the range of from about 0.2 or 0.25 wt. % to about 0.45 or 0.5 wt. %.

In some embodiments, the aluminum alloy includes at least about 0.15 or 0.2 wt. % Mg. In some embodiments, the aluminum alloy includes not greater than about 0.5 or 0.4 wt. % Mg. In some embodiments, the aluminum alloy includes manganese in the range of from about 0.15 or 0.2 wt. % to about 0.4 or 0.5 wt. %.

In one embodiment, the grain structure control element is Zr. In some of these embodiments, the aluminum alloy includes 0.05-0.15 wt. % Zr.

In one embodiment, the impurities include Fe and Si. In some of these embodiments, the alloy includes not greater than about 0.06 wt. % Si (e.g., ≦0.03 wt. % Si) and not greater than about 0.08 wt. % Fe (e.g., ≦0.04 wt. % Fe).

The aluminum alloy may realize an improved combination of mechanical properties and corrosion resistant properties. In one embodiment, an aluminum alloy realizes a longitudinal tensile yield strength of at least about 86 ksi. In one embodiment, the aluminum alloy realizes an L-T plane strain fracture toughness of at least about 20 ksi√in. In one embodiment, the aluminum alloy realizes a typical tension modulus of at least about $11.3\times10^3$ ksi and a typical compression modulus of at least about $11.6\times10^3$ ksi. In one embodiment, the aluminum alloy has a density of not greater than about 0.097 lbs./in$^3$. In one embodiment, the aluminum alloy has a specific strength of at least about $8.66\times10^5$ in. In one embodiment, the aluminum alloy realizes a compressive yield strength of at least about 90 ksi. In one embodiment, the aluminum alloy is resistant to stress corrosion cracking. In one embodiment, the aluminum alloy achieves a MASTMAASIS rating of at least EA. In one embodiment, the alloy is resistant to galvanic corrosion. In some aspects, a single aluminum alloy may realize numerous ones (or even all) of the above properties. In one embodiment, the aluminum alloy at least realizes a longitudinal strength of at least about 84 ksi, an L-T plane strain fracture toughness of at least about 20 ksi√in, is resistant to stress corrosion cracking and is resistant to galvanic corrosion.

These and other aspects, advantages, and novel features of the new alloys are set forth in part in the description that follows, and become apparent to those skilled in the art upon examination of the following description and figures, or may be learned by production of or use of the alloy.

BRIEF DESCRIPTION OF THE DRAWINGS

FIG. 1*b* is a dimension and tolerance table relating to FIG. 1*a*.

DETAILED DESCRIPTION

Figure 1A:
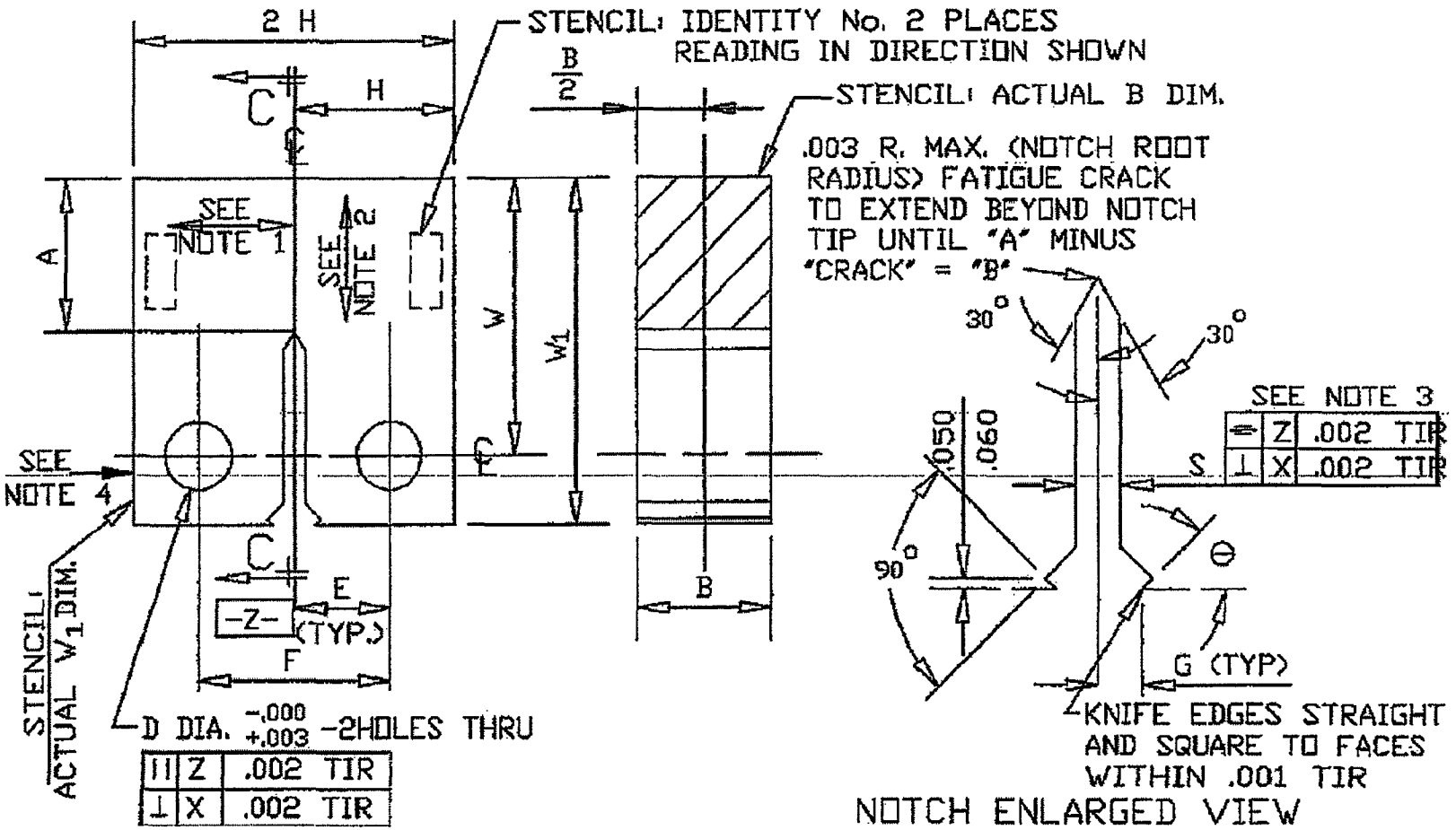
FIG. 1*a* is a schematic view illustrating one embodiment of a test specimen for use in fracture toughness testing.

Reference will now be made in detail to the accompanying drawings, which at least assist in illustrating various pertinent embodiments of the new alloy.

Broadly, the instant disclosure relates to aluminum-copper-lithium alloys having an improved combination of properties. The aluminum alloys generally comprise (and in some instances consist essentially of) copper, lithium, zinc, silver, magnesium, and manganese, the balance being aluminum, optional grain structure control elements, optional incidental elements and impurities. The composition limits of several alloys useful in accordance with the present teachings are disclosed in Table 1, below. The composition limits of several prior art alloys are disclosed in Table 2, below. All values given are in weight percent.

TABLE 1

New Alloy Compositions

| Alloy | Cu | Li | Zn | Ag | Mg | Mn |
|---|---|---|---|---|---|---|
| A | 3.4-4.2% | 0.9-1.4% | 0.2-0.8% | 0.3-0.7% | 0.1-0.6% | 0.1-0.6% |
| B | 3.6-4.1% | 1.0-1.3% | 0.3-0.7% | 0.4-0.6% | 0.2-0.5% | 0.1-0.4% |
| C | 3.8-4.0% | 1.1-1.2% | 0.4-0.6% | 0.4-0.6% | 0.25-0.45% | 0.2-0.4% |

TABLE 2

Prior Art Extruded Alloy Compositions

| Alloy | Cu | Li | Zn | Ag | Mg | Mn |
|---|---|---|---|---|---|---|
| 2099 | 2.4-3.0% | 1.6-2.0% | 0.4-1.0% | — | 0.1-0.5% | 0.1-0.5% |
| 2195 | 3.7-4.3% | 0.8-1.2% | Max 0.25 wt. % as impurity | 0.25-0.6% | 0.25-0.8% | Max 0.25 wt. % as impurity |
| 2196 | 2.5-3.3% | 1.4-2.1% | Max 0.35 wt. % as impurity | 0.25-0.6% | 0.25-0.8% | Max 0.35 wt. % as impurity |
| 7055 | 2.0-2.6% | — | 7.6-8.4% | — | 1.8-2.3% | Max 0.05 wt. % as impurity |
| 7150 | 1.9-2.5% | — | 5.9-6.9% | — | 2.0-2.7% | Max 0.10 wt. % as impurity |

The alloys of the present disclosure generally include the stated alloying ingredients, the balance being aluminum, optional grain structure control elements, optional incidental elements and impurities. As used herein, "grain structure control element" means elements or compounds that are deliberate alloying additions with the goal of forming second phase particles, usually in the solid state, to control solid state grain structure changes during thermal processes, such as recovery and recrystallization. Examples of grain structure control elements include Zr, Sc, V, Cr, and Hf, to name a few.

The amount of grain structure control material utilized in an alloy is generally dependent on the type of material utilized for grain structure control and the alloy production process. When zirconium (Zr) is included in the alloy, it may be included in an amount up to about 0.4 wt. %, or up to about 0.3 wt. %, or up to about 0.2 wt. %. In some embodiments, Zr is included in the alloy in an amount of 0.05-0.15 wt. %. Scandium (Sc), vanadium (V), chromium (Cr), and/or hafnium (Hf) may be included in the alloy as a substitute (in whole or in part) for Zr, and thus may be included in the alloy in the same or similar amounts as Zr.

While not considered a grain structure control element for the purposes of this application, manganese (Mn) may be included in the alloy in addition to or as a substitute (in whole or in part) for Zr. When Mn is include in the alloy, it may be included in the amounts disclosed above.

As used herein, "incidental elements" means those elements or materials that may optionally be added to the alloy to assist in the production of the alloy. Examples of incidental elements include casting aids, such as grain refiners and deoxidizers.

Grain refiners are inoculants or nuclei to seed new grains during solidification of the alloy. An example of a grain refiner is a ⅜ inch rod comprising 96% aluminum, 3% titanium (Ti) and 1% boron (B), where virtually all boron is present as finely dispersed $TiB_2$ particles. During casting, the grain refining rod is fed in-line into the molten alloy flowing into the casting pit at a controlled rate. The amount of grain refiner included in the alloy is generally dependent on the type of material utilized for grain refining and the alloy production process. Examples of grain refiners include Ti combined with B (e.g., $TiB_2$) or carbon (TiC), although other grain refiners, such as Al—Ti master alloys may be utilized. Generally, grain refiners are added in an amount of ranging from 0.0003 wt. % to 0.005 wt. % to the alloy, depending on the desired as-cast grain size. In addition, Ti may be separately added to the alloy in an amount up to 0.03 wt. % to increase the effectiveness of grain refiner. When Ti is included in the alloy, it is generally present in an amount of up to about 0.10 or 0.20 wt. %.

Some alloying elements, generally referred to herein as deoxidizers, may be added to the alloy during casting to reduce or restrict (and is some instances eliminate) cracking of the ingot resulting from, for example, oxide fold, pit and oxide patches. Examples of deoxidizers include Ca, Sr, and Be. When calcium (Ca) is included in the alloy, it is generally present in an amount of up to about 0.05 wt. %, or up to about 0.03 wt. %. In some embodiments, Ca is included in the alloy in an amount of 0.001-0.03 wt % or 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 20 ppm.

Incidental elements may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

As used herein, impurities are those materials that may be present in the alloy in minor amounts due to, for example, the inherent properties of aluminum or and/or leaching from contact with manufacturing equipment. Iron (Fe) and silicon (Si) are examples of impurities generally present in aluminum alloys. The Fe content of the alloy should generally not exceed about 0.25 wt. %. In some embodiments, the Fe content of the alloy is not greater than about 0.15 wt. %, or not greater than about 0.10 wt. %, or not greater than about 0.08 wt. %, or not greater than about 0.05 or 0.04 wt. %. Likewise, the Si content of the alloy should generally not exceed about 0.25 wt. %, and is generally less than the Fe content. In some embodiments, the Si content of the alloy is not greater than about 0.12 wt. %, or not greater than about 0.10 wt. %, or not greater than about 0.06 wt. %, or not greater than about 0.03 or 0.02 wt. %.

Except where stated otherwise, the expression "up to" when referring to the amount of an element means that that elemental composition is optional and includes a zero amount of that particular compositional component. Unless stated otherwise, all compositional percentages are in weight percent (wt. %).

The alloys can be prepared by more or less conventional practices including melting and direct chill (DC) casting into ingot form. Conventional grain refiners, such as those containing titanium and boron, or titanium and carbon, may also be used as is well-known in the art. After conventional scalping, lathing or peeling (if needed) and homogenization, these ingots are further processed into wrought product by, for example, hot rolling into sheet (≦0.249 inch) or plate (≧0.250 inch) or extruding or forging into special shaped sections. In the case of extrusions, the product may be solution heat treated (SHT) and quenched, and then mechanically stress relieved, such as by stretching and/or compression up to about 4% permanent strain, for example, from about 1 to 3%, or 1 to 4%. Similar SHT, quench, stress relief and artificial aging operations may also be completed to manufacture rolled products (e.g., sheet/plate) and/or forged products.

The new alloys disclosed herein achieve an improved combination of properties relative to 7xxx and other 2xxx series alloys. For example, the new alloys may achieve an improved combination of two or more of the following properties: ultimate tensile strength (UTS), tensile yield strength (TYS), compressive yield strength (CYS), elongation (El) fracture toughness (FT), specific strength, modulus (tensile and/or compressive), specific modulus, corrosion resistance, and fatigue, to name a few. In some instances, it is possible to achieve at least some of these properties without high amounts of accumulated cold work, such as those used for prior Al—Li products such as 2090-T86 extrusions. Realizing these properties with low amounts of accumulated cold work is beneficial in extruded products. Extruded products generally cannot be compressively worked, and high amounts of stretch make it highly difficult to maintain dimensional tolerances, such as cross-sectional measurements and attribute tolerances, including angularity and straightness, as described in the ANSI H35.2 specification.

With respect to strength and elongation, the alloys may achieve a longitudinal (L) ultimate tensile strength of at least about 92 ksi, or even at least about 100 ksi. The alloys may achieve a longitudinal tensile yield strength of at least about 84 ksi, or at least about 86 ksi, or at least about 88 ksi, or at least about 90 ksi, or even at least about 97 ksi. The alloys may achieve a longitudinal compressive yield strength of at least about 88 ksi, or at least about 90 ksi, or at least about 94 ksi, or even at least about 98 ksi. The alloys may achieve an elongation of at least about 7%, or even at least about 10%. In one embodiment, the ultimate tensile strength and/or tensile yield strength and/or elongation is measured in accordance with ASTM E8 and/or B557, and at the quarter-plane of the product. In one embodiment, the product (e.g., the extrusion) has a thickness in the range of 0.500-2.000 inches. In one embodiment, the compressive yield strength is measured in accordance with ASTM E9 and/or E111, and at the quarter-plane of the product. It may be appreciated that strength can vary somewhat with thickness. For example, thin (e.g., <0.500 inch) or thick products (e.g., >3.0 inches) may have somewhat lower strengths than those described above. Nonetheless, those thin or thick products still provide distinct advantages relative to previously available alloy products.

With respect to fracture toughness, the alloys may achieve a long-transverse (L-T) plane strain fracture toughness of at least about 20 ksi√in., or at least about 23 ksi√in., or at least about 27 ksi√in., or even at least about 31 ksi√in. In one embodiment, the fracture toughness is measured in accordance with ASTM E399 at the quarter-plane, and with the specimen configuration illustrated in FIG. 1*a*. It may be appreciated that fracture toughness can vary somewhat with thickness and testing conditions. For example, thick products (e.g., >3.0 inches) may have somewhat lower fracture toughness than those described above. Nonetheless, those thick products still provide distinct advantages relative to previously available products.

With respect to FIG. 1*a*, a dimension and tolerances table is provided in FIG. 1*b*. Note 1 of FIG. 1*a* states grains in this direction for L-T and L-S specimens. Note 2 of FIG. 1*a* states grain in this direction for T-L and T-S specimens. Note 3 of FIG. 1*a* states S notch dimension shown is maximum, if necessary may be narrower. Note 4 of FIG. 1*a* states to check for residual stress, measure and record height (2H) of specimen at position noted both before and after machining notch. All tolerances are as follows (unless otherwise noted): 0.0=+/−0.1; 0.00=+/−0.01; 0.000=+/−0.005.

With respect to specific tensile strength, the alloys may realize a density of not greater than about 0.097 lb/in$^3$, such as in the range of 0.096 to 0.097 lb/in$^3$. Thus, the alloys may realize a specific tensile yield strength of at least about $8.66\times10^5$ in. ((84 ksi*1000=84,000 lb./in)/(0.097 lb./in$^3$=about 866,000 in.), or at least about $8.87\times10^5$ in., or at least about $9.07\times10^5$ in., or at least about $9.28\times10^5$ in., or even at least about $10.0\times10^5$ in.

With respect to modulus, the alloys may achieve a typical tensile modulus of at least about 11.3 or $11.4\times10^3$ ksi. The alloys may realize a typical compressive modulus of at least about 11.6 or $11.7\times10^3$ ksi. In one embodiment, the modulus (tensile or compressive) may be measured in accordance with ASTM E111 and/or B557, and at the quarter-plane of the specimen. The alloys may realize a specific tensile modulus of at least about $1.16\times10^8$ in. (($11.3\times10^3$ ksi*1000=$11.3*10^6$ lb./in.)/(0.097 lb./in$^3$=about $1.16\times10^8$ in.). The alloys may realize a specific compression modulus of at least about $1.19\times10^8$ in.

With respect to corrosion resistance, the alloys may be resistant to stress corrosion cracking. As used herein, resistant to stress corrosion cracking means that the alloys pass an alternate immersion corrosion test (3.5 wt. % NaCl) while being stressed (i) at least about 55 ksi in the LT direction, and/or (ii) at least about 25 ksi in the ST direction. In one embodiment, the stress corrosion cracking tests are conducted in accordance with ASTM G47.

With respect to exfoliation corrosion resistance, the alloys may achieve at least an "EA" rating, or at least an "N" rating, or even at least an "P" rating in a MASTMAASIS testing process for either or both of the T/2 or T/10 planes of the product, or other relevant test planes and locations. In one embodiment, the MASTMAASIS tests are conducted in accordance with ASTM G85-Annex 2 and/or ASTM G34.

The alloys may realize improved galvanic corrosion resistance, achieving low corrosion rates when connected to a cathode, which is known to accelerate corrosion of aluminum alloys. Galvanic corrosion refers to the process in which corrosion of a given material, usually a metal, is accelerated by connection to another electrically conductive material. The morphology of this type of accelerated corrosion can vary depending on the material and environment, but could include pitting, intergranular, exfoliation, and other known forms of corrosion. Often this acceleration is dramatic, causing materials that would otherwise be highly resistant to corrosion to deteriorate rapidly, thereby shortening structure lifetime. Galvanic corrosion resistance is a consideration for modern aircraft designs. Some modern aircraft may combine many different materials, such as aluminum with carbon fiber reinforced plastic composites (CFRP) and/or titanium parts. Some of these parts are very cathodic to aluminum, meaning that the part or structure produced from an aluminum alloy may experience accelerated corrosion rates when in electrical communication (e.g., direct contact) with these materials.

In one embodiment, the new alloy disclosed herein is resistant to galvanic corrosion. As used herein, "resistant to galvanic corrosion" means that the new alloy achieves at least 50% lower current density (uA/cm$^2$) in a quiescent 3.5% NaCl solution at a potential of from about −0.7 to about −0.6 (volts versus a saturated calomel electrode (SCE)) than a 7xxx alloy of similar size and shape, and which 7xxx alloy has a similar strength and toughness to that of the new alloy. Some 7xxx alloys suitable for this comparative purpose include 7055 and 7150. The galvanic corrosion resistance tests are performed by immersing the alloy sample in the quiescent solution and then measuring corrosion rates by monitoring electrical current density at the noted electrochemical potentials (measured in volts vs. a saturated calomel electrode). This test simulates connection with a cathodic material, such as those described above. In some embodiments, the new alloy achieves at least 75%, or at least 90%, or at least 95%, or even at least 98% or 99% lower current density (uA/cm$^2$) in a quiescent 3.5% NaCl solution at a potential of from about −0.7 to about −0.6 (volts versus SCE) than a 7xxx alloy of similar size and shape, and which 7xxx alloy has a similar strength and toughness to that of the new alloy.

Since the new alloy achieves better galvanic corrosion resistance and a lower density than these 7xxx alloys, while achieving similar strength and toughness, the new alloy is well suited as a replacement for these 7xxx alloys. The new alloy may even be used in applications for which the 7xxx alloys would be rejected because of corrosion concerns.

With respect to fatigue, the alloys may realize a notched S/N fatigue life of at least about 90,000 cycles, on average, for a 0.95 inch thick extrusion, at a max stress of 35 ksi. The alloys may achieve a notched S/N fatigue life of at least about 75,000 cycles, on average for a 3.625 inches thick extrusion at a max stress of 35 ksi. Similar values may be achieved for other wrought products.

Table 3, below, lists some extrusion properties of the new alloy and several prior art extrusion alloys.

TABLE 3

Properties of extruded alloys

| | New Alloy | 2099-T-83 | 2196-T8511 | 7150-T77 | 7055-T77 |
|---|---|---|---|---|---|
| Thickness (inches) | 0.500-2.000 | 0.500-3.000 | 0.236-0.984 | 0.750-2.000 | 0.500-1.500 |
| UTS (L) (ksi) | 92 | 80 | 78.3 | 89 | 94 |
| TYS (L) (ksi) | 88 | 72 | 71.1 | 83 | 90 |
| El. % (L) | 7 | 7 | 5 | 8 | 9 |
| CYS (ksi) | 90 | 70 | 71.1 | 82 | 92 |
| Shear Ultimate Strength (ksi) | 48 | 41 | — | 44 | 48 |
| Bearing Ultimate Strength e/D = 1.5 (ksi) | 110 | 104 | 99.3 | 118 | 128 |
| Bearing Yield Strength e/D = 1.5 (ksi) | 100 | 85 | 87 | 96 | 109 |
| Bearing Ultimate Strength e/D = 2.0 (ksi) | 150 | 135 | 136.3 | 152 | 167 |
| Bearing Yield Strength e/D = 1.5 (ksi) | 115 | 103 | 104.4 | 117 | 131 |
| Tensile modulus (E) - Typical ($10^3$ ksi) | 11.4 | 11.4 | 11.3 | 10.4 | 10.4 |
| Compressive modulus (Ec) - Typical ($10^3$ ksi) | 11.6 | 11.9 | 11.6 | 11.0 | 11.0 |
| Density (lb./in$^3$) | 0.097 | 0.095 | 0.095 | 0.102 | 0.103 |
| Specific TYS ($10^5$ in.) | 9.07 | 7.58 | 7.48 | 8.14 | 8.74 |
| Toughness (L-T) (ksi√in.) | 27 (typical) | | — | 24 | 27 |

Figure 2:
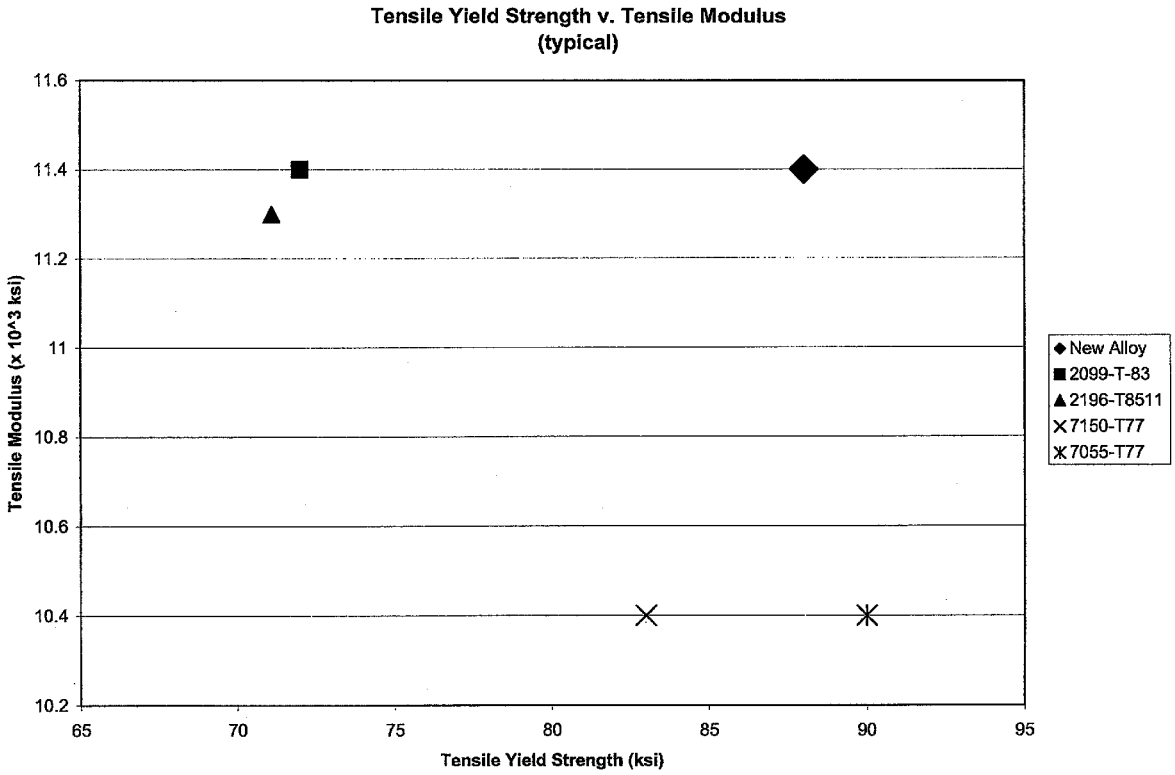
FIG. 2 is a graph illustrating typical tensile yield strength versus tensile modulus values for various alloys.
Figure 3:
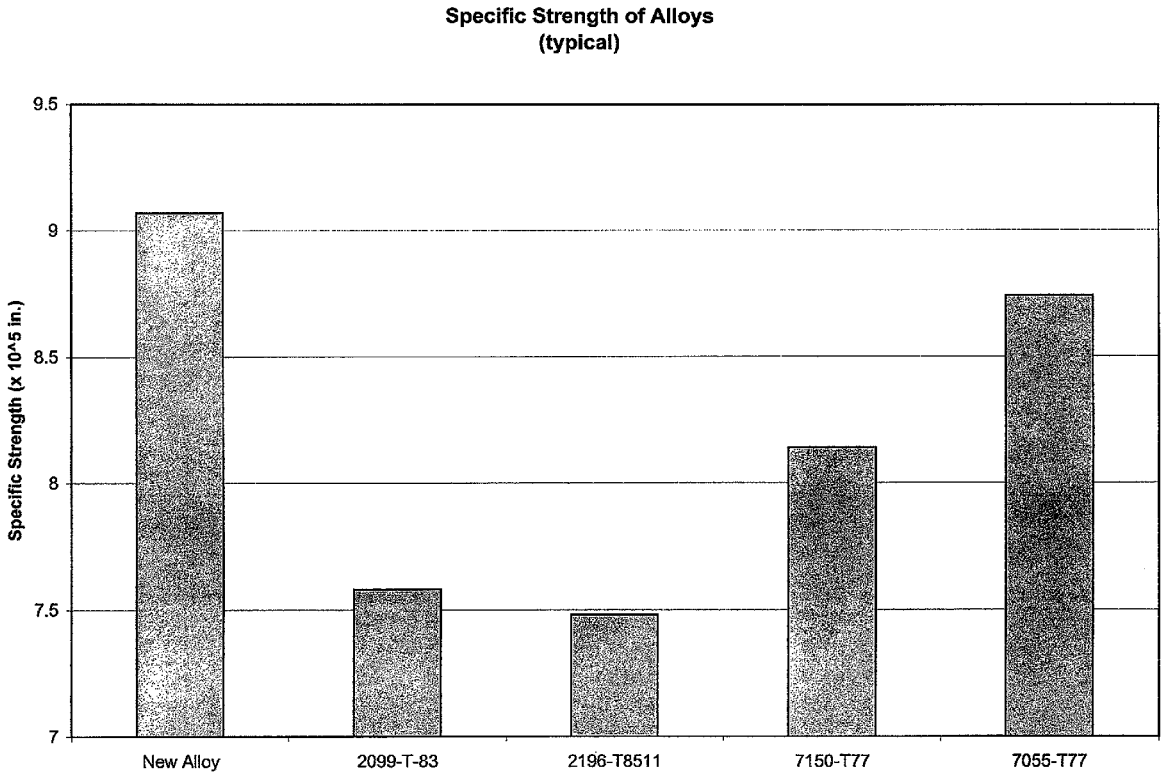
FIG. 3 is a graph illustrating typical specific tensile yield strength values for various alloys.

As illustrated above, the new alloy realizes an improved combination of mechanical properties relative to the prior art alloys. For example, and as illustrated in FIG. 2, the new alloy realizes an improved combination of strength and modulus relative to the prior art alloys. As another example, and as illustrated in FIG. 3, the new alloy realizes improved specific tensile yield strength relative to the prior art alloys.

Designers select aluminum alloys to produce a variety of structures to achieve specific design goals, such as light weight, good durability, low maintenance costs, and good corrosion resistance. The new aluminum alloy, due to its improved combination of properties, may be employed in many structures including vehicles such as airplanes, bicycles, automobiles, trains, recreational equipment, and piping, to name a few. Examples of some typical uses of the new alloy in extruded form relative to airplane construction include stringers (e.g., wing or fuselage), spars (integral or non-integral), ribs, integral panels, frames, keel beams, floor beams, seat tracks, false rails, general floor structure, pylons and engine surrounds, to name a few.

The alloys may be produced by a series of conventional aluminum alloy processing steps, including casting, homogenization, solution heat treatment, quench, stretch and/or aging. In one approach, the alloy is made into a product, such as an ingot derived product, suitable for extruding. For instance, large ingots can be semi-continuously cast having the compositions described above. The ingot may then be preheated to homogenize and solutionize its interior structure. A suitable preheat treatment step heats the ingot to a relatively high temperature, such as about 955° F. In doing so, it is preferred to heat to a first lesser temperature level, such as heating above 900° F., for instance about 925-940° F., and then hold the ingot at that temperature for several hours (e.g., 7 or 8 hours). Next the ingot is heated to the final holding temperature (e.g., 940-955° F. and held at that temperature for several hours (e.g., 2-4 hours).

The homogenization step is generally conducted at cumulative hold times in the neighborhood of 4 to 20 hours, or more. The homogenizing temperatures are generally the same as the final preheat temperature (e.g., 940-955° F.). Overall, the cumulative hold time at temperatures above 940° F. should be at least 4 hours, such as 8 to 20 or 24 hours, or more, depending on, for example, ingot size. Preheat and homogenization aid in keeping the combined total volume percent of insoluble and soluble constituents low, although high temperatures warrant caution to avoid partial melting. Such cautions can include careful heat-ups, including slow or step-type heating, or both.

Next, the ingot may be scalped and/or machined to remove surface imperfections, as needed, or to provide a good extrusion surface, depending on the extrusion method. The ingot may then be cut into individual billets and reheated. The reheat temperatures are generally in the range of 700-800° F. and the reheat period varies from a few minutes to several hours, depending on the size of the billet and the capability of the furnace used for processing.

Next, the ingot may be extruded via a heated setup, such as a die or other tooling set at elevated temperatures (e.g., 650-900° F.) and may include a reduction in cross-sectional area (extrusion ratio) of about 7:1 or more. The extrusion speed is generally in the range of 3-12 feet per minute, depending on the reheat and tooling and/or die temperatures. As a result the extruded aluminum alloy product may exit the tooling at a temperature in the range of, for example, 830-880° F.

Next, the extrusion may be solution heat treated (SHT) by heating at elevated temperature, generally 940-955° F. to take into solution all or nearly all of the alloying elements at the SHT temperature. After heating to the elevated temperature and holding for a time appropriate for the extrusion section being processed in the furnace, the product may be quenched by immersion or spraying, as is known in the art. After quenching, certain products may need to be cold worked, such as by stretching or compression, so as to relieve internal stresses or straighten the product, and, in some cases, to further strengthen the product. For instance, an extrusion may have an accumulated stretch of as little as 1% or 2%, and, in some instance, up to 2.5%, or 3%, or 3.5%, or, in some cases, up to 4%, or a similar amount of accumulated cold work. As used herein, accumulated cold work means cold work accumulated in the product after solution heat treatment, whether by stretching or otherwise. A solution heat treated and quenched product, with or without cold working, is then in a precipitation-hardenable condition, or ready for artificial aging, described below. As used herein, "solution heat treat" includes quenching, unless indicated otherwise. Other wrought product forms may be subject to other types of cold deformation prior to aging. For example, plate products may be stretched 4-6% and optionally cold rolled 8-16% prior to stretching.

After solution heat treatment and cold work (if appropriate), the product may be artificially aged by heating to an appropriate temperature to improve strength and/or other properties. In one approach, the thermal aging treatment includes two main aging steps. It is generally known that ramping up to and/or down from a given or target treatment temperature, in itself, can produce precipitation (aging) effects which can, and often need to be, taken into account by integrating such ramping conditions and their precipitation hardening effects into the total aging treatments. In one embodiment, the first stage aging occurs in the temperature range of 200-275° F. and for a period of about 12-17 hours. In one embodiment, the second stage aging occurs in the temperature range of 290-325° F., and for a period of about 16-22 hours.

The above procedures relates to methods of producing extrusions, but those skilled in the art recognized that these procedures may be suitably modified, without undue experimentation, to produce sheet/plate and/or forgings of this alloy.

EXAMPLES

Example 1

Two ingots, 23" diameter×125" long, are cast. The approximate composition of the ingots is provided in Table 4, below (all values in weight percent). The density of the alloy is 0.097 lb/in$^3$.

TABLE 4

| Composition of Cast Alloy | | | | | | |
|---|---|---|---|---|---|---|
| Cu | Li | Zn | Ag | Mg | Mn | Balance |
| 3.92% | 1.18% | 0.52% | 0.48% | 0.34% | 0.34% | aluminum, grain structure control elements, incidental elements and impurities |

The two ingots are stress relieved, cropped to 105" lengths each and ultrasonically inspected. The billets are homogenized as follows:

18 hour ramp to 930° F.;
8 hour hold at 930° F.;
16 hour ramp to 946° F.;
48 hour hold at 946° F.
(furnace requirements of −5° F., +110° F.)

The billets are then cut to the following lengths:

43"—qty of 1
31"—qty of 1
30"—qty of 1
44"—qty of 1

Final billet preparation (pealed to the desired diameter) for extrusion trials are completed. The extrusion trial process involves evaluation of 4 large press shapes and 3 small press shapes. Three of the large press shapes are extruded to characterize the extrusion settings and material properties for an indirect extrusion process and one large press shape for a direct extrusion process. Three of the four large press shape thicknesses extruded for this evaluation ranged from 0.472" to 1.35". The fourth large press shape is a 6.5" diameter rod. The three small press shapes are extruded to characterize the extrusion settings and material properties for the indirect extrusion process. The small press shape thicknesses range from 0.040" to 0.200". The large press extrusion speeds range from 4 to 11 feet per minute, and the small press extrusion speeds range from 4 to 6 feet per minute.

Following the extrusion process, each parent shape is individually heat treated, quenched, and stretched. Heat treatment is accomplished at about 945-955° F., with a one hour soak. A stretch of 2.5% is targeted.

Representative etch slices for each shape are examined and reveal recrystallization layers ranging from 0.001 to 0.010 inches. Some of the thinner small press shapes do, however, exhibit a mixed grain (recrystallized and unrecrystallized) microstructure.

Single step aging curves at 270 and 290° F. for large press shapes are created. The results indicate that the alloy has a high toughness, and at the same time approaching the static tensile strengths of a comparable 7xxx product (e.g., 7150-T77511).

To further improve the strength of the alloy, a multi-step age practice is developed. Multi-step age combinations are evaluated to improve the strength—toughness relationship, while also endeavoring to achieve the static property targets of known high strength 7xxx alloys. The finally developed multi-step aging practice is a first aging step at 270° F. for about 15 hours, and a second aging step at about 320° F. for about 18 hours.

Corrosion testing is performed during temper development. Stress corrosion cracking (SCC) tests are performed in accordance with ASTM G47 and G49 on the sample alloy, and in the direction and stress combinations of LT/55 ksi and ST/25 ksi. The alloys passes the SCC tests even after 155 days.

MASTMAASIS testing (intermittent salt spray test) is also performed, and reveals only a slight degree of exfoliation at the T/10 and T2 planes for single and multi-step age practices. The MASTMAASIS results yield a "P" rating for the alloys at both T/2 and T/10 planes.

The alloys are subjected to various mechanical tests at various thicknesses. Those results are provided in Table 5, below.

TABLE 5

Properties of tested alloys (average)

| Alloy | Temper | Thickness (inches) | UTS (L) (ksi) | TYS (L) (ksi) | El. % (L) | CYS (ksi) | Density (lb./in$^3$) | Toughness (L-T) (ksi$\sqrt{in}$.) |
|---|---|---|---|---|---|---|---|---|
| New | T8 | 0.04-0.200 | 88.8 | 84.1 | 8.1 | — | 0.097 | — |
| New | T8 | 0.472 | 98.7 | 95.8 | 9.3 | 101 | 0.097 | — |
| New | T8 | 0.787-1.35 | 94.6 | 90.8 | 9.4 | 93.6 | 0.097 | 27.6 |

As illustrated in Table 3, above, and via these results, the alloys realize an improved combination of strength and toughness over conventionally extruded alloys 2099 and 2196. The alloys also realize similar strength and toughness relative to conventional 7xxx alloys 7055 and 7150, but are much lighter, providing a higher specific strength than the 7xxx alloys. The new alloys also achieve a much better tensile and compressive modulus relative to the 7xxx alloys. This combination of properties is unique and unexpected.

Example 2

Ten 23" diameter ingots are cast. The approximate composition of the ingots is provided in Table 6, below (all values are weight percent). The density of the alloy is 0.097 lb/in$^3$.

TABLE 6

Composition of Cast Alloy

| Cast | Cu | Li | Zn | Ag | Mg | Mn | Balance |
|---|---|---|---|---|---|---|---|
| 1-A | 3.95% | 1.18% | 0.53% | 0.50% | 0.36% | 0.26% | aluminum, grain structure control elements, incidental elements and impurities |
| 1-B | 3.81% | 1.15% | 0.49% | 0.49% | 0.34% | 0.28% | |

The ingots are stress relieved and three ingots of cast 1-A and three ingots of cast 1-B are homogenized as follows:

Furnace set at 940° F. and charge all 6 ingots into said furnace;

8 hour soak at 925-940° F.;

Following 8 hour hold, reset the furnace to 948° F.;

After 4 hours, reset the furnace to 955° F.;

24 hour hold 940-955° F.

The billets are cut to length and pealed to the desired diameter. The billets are extruded into 7 large press shapes. The shape thicknesses range from 0.75 inch to 7 inches thick. Extrusion speeds and press thermal settings are in the range of 3-12 feet per minute, and at from about 690-710° F. to about 750-810° F. Following the extrusion process, each parent shape is individually solution heat treated, quenched and stretched. Solution heat treatments targeted 945-955° F., with soak times set, depending on extrusion thickness, in the range of 30 minutes to 75 minutes. A stretch of 3% is targeted.

Representative etch slices for each shape are examined and reveal recrystallization layers ranging from 0.001 to 0.010 inches. Multi-step aging cycles are completed to increase the strength and toughness combination. In particular, a first step aging is at about 270° F. for about 15 hours, and a second step aging is at about 320° F. for about 18 hours.

Stress corrosion cracking tests are performed in accordance with ASTM G47 and G49 on the sample alloy, and in the direction and stress combination of LT/55 ksi and ST/25 ksi, both located in the T/2 planes. The alloys pass the stress corrosion cracking tests.

MASTMAASIS testing (intermittent salt spray test) is also performed in accordance with ASTM G85-Annex 2 and/or ASTM G34. The alloys achieve a MASTMAASIS rating of "P".

Notched S/N fatigue testing is also performed in accordance with ASTM E466 at the T/2 plane to obtain stress-life (S-N or S/N) fatigue curves. Stress-life fatigue tests characterize a material's resistance to fatigue initiation and small crack growth which comprises a major portion of the total fatigue life. Hence, improvements in S-N fatigue properties may enable a component to operate at a higher stress over its design life or operate at the same stress with increased lifetime. The former can translate into significant weight savings by downsizing, while the latter can translate into fewer inspections and lower support costs.

Figure 4:
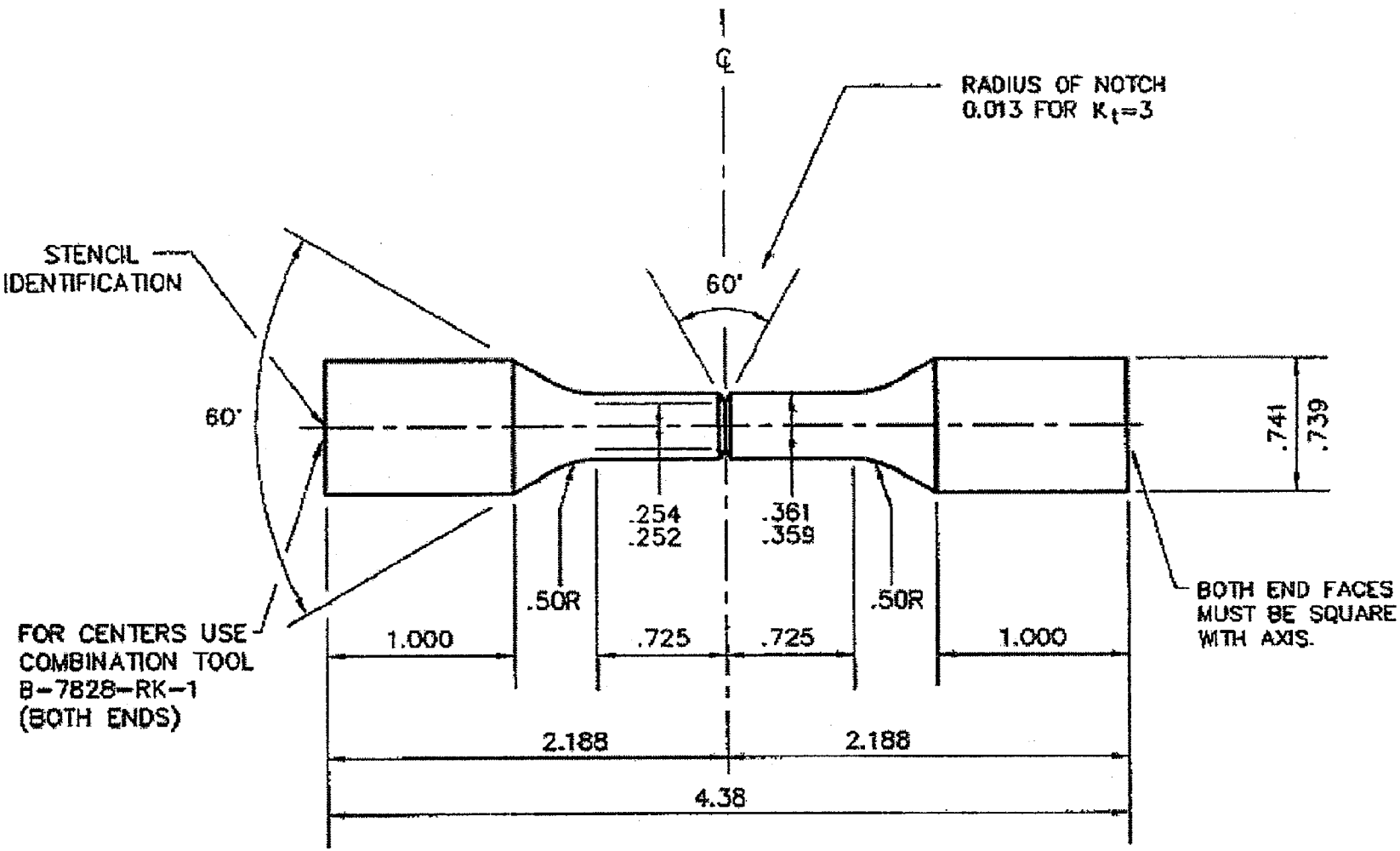
FIG. 4 is a schematic view illustrating one embodiment of a test coupon for use in notched S/N fatigue testing.

The S-N fatigue results are provided in Table 7, below. The results are obtained for a net max stress concentration factor, Kt, of 3.0 using notched test coupons. The test coupons are fabricated as illustrated in FIG. 4. The test coupons are stressed axially at a stress ratio (min load/max load) of R=0.1. The test frequency is 25 Hz, and the tests are performed in ambient laboratory air.

With respect to FIG. 4, to minimize residual stress, the notch should be machined as follows: (i) feed tool at 0.0005" per rev. until specimen is 0.280"; (ii) pull tool out to break chip; (iii) feed tool at 0.0005" per rev. to final notch diameter. Also, all specimens should be degreased and ultrasonically cleaned, and hydraulic grips should be utilized.

In these tests, the new alloy showed significant improvements in fatigue life with respect to the industry standard 7150-T77511 product. For example, at an applied net section stress of 35 ksi, the new alloy realizes a lifetime (based on the log average of all specimens tested at that stress) of 93,771 cycles compared to a typical 11,250 cycles for the standard 7150-T77511 alloy. As a maximum net stress of 27.5 ksi, the alloy realizes an average lifetime of 3,844,742 cycles compared to a typical 45,500 cycles at net stress of 25 ksi for the 7150-T77511 alloy. Those skilled in the art appreciate that fatigue lifetime will depend not only on stress concentration factor (Kt), but also on other factors including but not limited to specimen type and dimensions, thickness, method of surface preparation, test frequency and test environment. Thus, while the observed fatigue improvements in the new alloy corresponded to the specific test coupon type and dimensions noted, it is expected that improvements will be observed in other types and sizes of fatigue specimens although the lifetimes and magnitude of the improvement may differ.

TABLE 7

Notched S/N Fatigue Results

| Maximum net stress (ksi) | New alloy - 0.950 inch (cycles to failure) | New alloy - 3.625 inches (cycles to failure) |
|---|---|---|
| 35 | 78,960 | 61,321 |
| 35 | 129,632 | 86,167 |
| 35 | 110,873 | 82,415 |
| 35 | 61,147 | — |
| 35 | 105,514 | — |
| 35 | 76,501 | — |
| AVERAGE | 93,711 | 76,634 |
| 27.5 | 696,793 | |
| 27.5 | 2,120,044 | |
| 27.5 | 8,717,390 | |

The alloys are subjected to various mechanical tests at various thicknesses. Those results are provided in Table 8, below.

TABLE 8

Properties of extruded alloys (averages)

| | New Alloy | New Alloy | New Alloy |
|---|---|---|---|
| Thickness (inches) | 0.750 | 0.850 | 3.625 |
| UTS (L) (ksi) | 93.5 | 100.1 | 92.6 |
| TYS (L) (ksi) | 88.8 | 97.1 | 88.7 |
| El. % (L) | 10.4 | 9.9 | 7.9 |
| CYS (ksi) | 93.9 | 98.3 | 93.3 |
| Shear Ultimate Strength (ksi) | 52.1 | 51.6 | 53.1 |
| Bearing Ultimate Strength e/D = 1.5 (ksi) | 112.8 | 112.2 | 108.9 |
| Bearing Yield Strength e/D = 1.5 (ksi) | 130.7 | 130.3 | 124 |
| Bearing Ultimate Strength e/D = 2.0 (ksi) | 132.2 | 132.5 | 127.1 |
| Bearing Yield Strength e/D = 1.5 (ksi) | 168.4 | 168.1 | 160.9 |
| Tensile modulus (E) - Typical ($10^3$ ksi) | 11.4 | 11.4 | 11.4 |

TABLE 8-continued

Properties of extruded alloys (averages)

| | New Alloy | New Alloy | New Alloy |
|---|---|---|---|
| Compressive modulus (Ec) - Typical ($10^3$ ksi) | 11.6 | 11.7 | 11.7 |
| Density (lb./in$^3$) | 0.097 | 0.097 | 0.097 |
| Specific Tensile Yield Strength ($10^5$ in.) | 9.15 | 10.0 | 9.14 |
| Toughness (L-T) (ksi√in.) | — | 31.8 | 23.3 |

Figure 5:
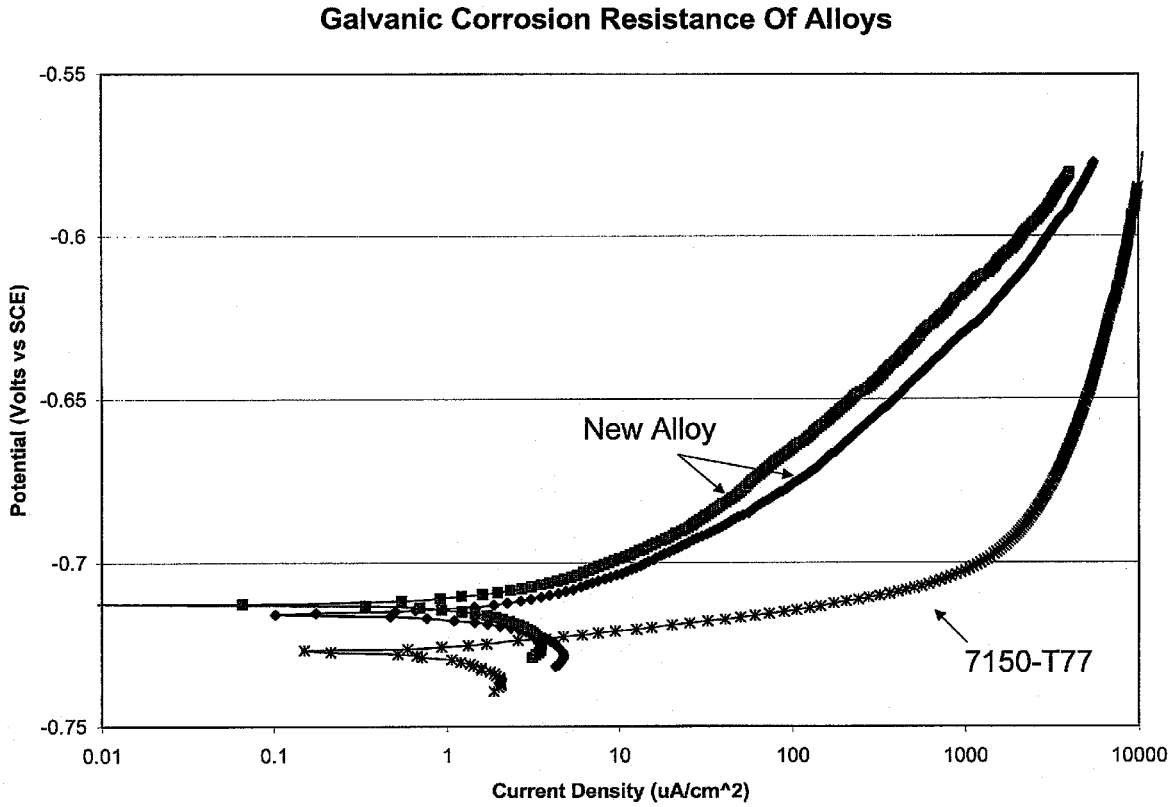
FIG. 5 is a graph illustrating the galvanic corrosion resistance of various alloys.

Galvanic corrosion tests are conducted in quiescent 3.5% NaCl solution. FIG. 5 is a graph illustrating the galvanic corrosion resistance of the new alloy. As illustrated, the new alloy realizes at least a 50% lower current density than alloy 7150, the degree of improvement varying somewhat with potential. Notably, at a potential of about −0.7V vs. SCE, the new alloy realizes a current density that is over 99% lower than alloy 7150, the new alloy having a current density of about 11 uA/cm$^2$, and alloy 7150 having a current density of about 1220 uA/cm$^2$ ((1220-11)/1220=99.1% lower).

While various embodiments of the present alloy have been described in detail, it is apparent that modifications and adaptations of those embodiments will occur to those skilled in the art. However, it is to be expressly understood that such modifications and adaptations are within the spirit and scope of the present disclosure.

What is claimed is:

1. A wrought aluminum alloy product consisting of:
3.4-4.2 wt. % Cu;
0.9-1.4 wt. % Li;
0.3-0.7 wt. % Ag;
0.1-0.6 wt. % Mg;
0.2-0.8 wt. % Zn;
0.1-0.6 wt. % Mn; and
0.05-0.15 wt. % Zr;
the balance being aluminum and incidental elements and impurities;
wherein the wrought aluminum alloy product realizes a longitudinal tensile yield strength of at least 86 ksi.

2. The wrought aluminum alloy product of claim 1, wherein the wrought aluminum alloy product consists of:
3.6-4.1 wt. % Cu;
1.0-1.3 wt. % Li;
0.3-0.7 wt. % Zn;
0.4-0.6 wt. % Ag;
0.2-0.5 wt. % Mg;
0.1-0.4 wt. % Mn; and
0.05-0.15 wt. % Zr;
the balance being aluminum and incidental elements and impurities.

3. The wrought aluminum alloy product of claim 1, wherein the wrought aluminum alloy product consists of:
3.7-4.0 wt. % Cu;
1.1-1.2 wt. % Li;
0.4-0.6 wt. % Zn;
0.4-0.6 wt. % Ag;
0.25-0.45 wt. % Mg;
0.2-0.4 wt. % Mn; and
0.05-0.15 wt. % Zr;
the balance being aluminum and incidental elements and impurities.

4. The wrought aluminum alloy product of any of claims 1 and 2-3, wherein the wrought aluminum alloy product is in the form of an extrusion, and has an accumulated cold work of not greater than an equivalent of 4% stretch.

5. The wrought aluminum alloy product of claim 1, wherein the impurities comprises Fe and Si, and wherein the wrought aluminum alloy product comprises not greater than 0.06 wt. % Si and not greater than 0.08 wt. % Fe.

6. The wrought aluminum alloy product of claim 1, wherein the wrought aluminum alloy product is resistant to galvanic corrosion.

7. An airplane spar comprising the extruded aluminum alloy product of claim 4.

8. An airplane stringer comprising the extruded aluminum alloy product of claim 4.

9. The wrought aluminum alloy product of claim 1, wherein the wrought aluminum alloy product realizes a longitudinal tensile yield strength of at least 88 ksi.

10. The wrought aluminum alloy product of claim 1, wherein the wrought aluminum alloy product realizes a longitudinal tensile yield strength of at least 90 ksi.

11. The wrought aluminum alloy product of claim 1, wherein the wrought aluminum alloy product realizes a longitudinal tensile yield strength of at least 91 ksi.

12. The wrought aluminum alloy product of claim 1, wherein the wrought aluminum alloy product realizes a longitudinal tensile yield strength of at least 96 ksi.

13. The wrought aluminum alloy product of any of claim 1 or 9-12, wherein the wrought aluminum alloy product realizes an L-T plane strain fracture toughness of at least 20 ksi√in.

14. The wrought aluminum alloy product of any of claim 1 or 9-12, wherein the extruded aluminum alloy product realizes an L-T plane strain fracture toughness of at least 23 ksi√in.

15. The wrought aluminum alloy product of any of claim 1 or 9-12, wherein the extruded aluminum alloy product realizes an L-T plane strain fracture toughness of at least 27 ksi√in.

16. The wrought aluminum alloy product of any of claim 1 or 9-12, wherein the extruded aluminum alloy product realizes an L-T plane strain fracture toughness of at least 31 ksi√in.

* * * * *